US006041772A

United States Patent [19]

Ward et al.

[11] Patent Number: 6,041,772

[45] Date of Patent: Mar. 28, 2000

[54] OVERHEAD VENTILATION SYSTEM INCORPORATING A FIXED BLADE DIFFUSER WITH OPPOSED PIVOTING BLADES FOR USE WITH A COOKING APPLIANCE

[75] Inventors: John M. Ward, Harrison Township; Gregory Kolecki, Ann Arbor, both of Mich.

[73] Assignee: EVS, Inc., Birmingham, Mich.

[21] Appl. No.: 09/191,174

[22] Filed: Nov. 13, 1998

[51] Int. Cl.[7] ..... F24C 15/20

[52] U.S. Cl. ..... 126/229 D; 126/299 R

[58] Field of Search ..... 126/299 D, 299 F, 126/299 R; 454/336, 326; 55/DIG. 36

[56] References Cited

U.S. PATENT DOCUMENTS

| | | | |
|---|---|---|---|
| 1,913,263 | 10/1933 | McKnight | 454/326 |
| 3,513,766 | 5/1970 | Ahlrich | 126/299 D |
| 3,910,782 | 10/1975 | Struble et al. | 126/299 D |
| 4,655,194 | 4/1987 | Wooden . | |
| 4,700,688 | 10/1987 | Searcy et al. . | |
| 5,467,761 | 11/1995 | Kuechler | 126/299 R |
| 5,522,377 | 6/1996 | Fritz . | |
| 5,738,083 | 4/1998 | Pettinari . | |
| 5,755,214 | 5/1998 | Lai . | |

*Primary Examiner*—Ira S. Lazarus
*Assistant Examiner*—Sara Clarke
*Attorney, Agent, or Firm*—Gifford, Krass, Groh, Sprinkle, Anderson & Citkowski, P.C.

[57] ABSTRACT

An overhead ventilation hood for use within a ventilation system of a conventional cooking appliance. The hood includes a housing with a planar base surface and a recessed interior arrayed in a downwardly facing manner which is defined by a first side, a second spaced apart side, a first interconnecting end and a second interconnecting end. Intake and exhaust openings are formed through the housing proximate the first and second sides. The ventilation system includes a first blower mounted in communication with a first length of ductwork extending to the intake opening to provide a stream of pressurized intake air and a second blower mounted in communication with a second length of ductwork extending from the exhaust opening to provide a stream of pressurized exhaust air. A supply plenum chamber is established along the first side of the housing interior and includes first and second planar shaped channeling walls and a planar shaped diffuser for regulating a flow of the stream of pressurized air into a central open interior of the housing. The diffuser includes fixed grid members and spaced apart and pivotal blade members to adjust an airflow through the plenum chamber. An exhaust plenum chamber is established along the second side of the housing interior and includes an elongate planar shaped and angularly mounted filter. Combinations of heat, airborne grease and smoke are issued upwardly from the cooking appliance within the open interior of the hood and are discharged through the filter and within the stream of exhaust air concurrent with intermixing with the regulated flow of the stream of intake air.

18 Claims, 3 Drawing Sheets

OVERHEAD VENTILATION SYSTEM INCORPORATING A FIXED BLADE DIFFUSER WITH OPPOSED PIVOTING BLADES FOR USE WITH A COOKING APPLIANCE

BACKGROUND OF THE INVENTION

1. Field of the Invention

The present invention relates generally to overhead ventilation systems for use with ovens and other cooking appliances and, more particularly, to a ventilator hood for removing heat, airborne grease and smoke from such cooking appliances which incorporate a fixed blade damper so as to create an airflow equilibrium within the hood so as to minimize the loss of quality interior air.

2. Description of the Prior Art

The prior art is well documented with ventilation hoods utilized in ventilation systems for facilitating the removal of heat, airborne grease and smoke from the cooking devices, and in particular commercial cooking equipment such as ranges, pizza ovens and the like. The objective of each such ventilation system is the ability to evacuate the undesirable by-products of the cooking appliance in such a manner so as not to affect the air quality established within the room enclosure surrounding the oven. This is preferably accomplished by providing a separate air inlet to the ventilation hood in addition to the exhaust outlet in the attempt to achieve an air equilibrium condition within the hood so as not to evacuate the quality conditioned (heated or cooled) air within the surrounding room enclosure.

U.S. Pat. No. 5,713,346, issued to Kuechler, discloses an exhaust hood ventilating system which utilizes both intake and exhaust blowers and means for regulating the volume of air introduced within the ventilation hood. Additional means are disclosed for creating a vortex flow within the hood enclosure and for diverting outdoor intake air into a surrounding kitchen area for ventilation before it is passed back to the hood for exhaust to the outdoors.

U.S. Pat. No. 5,467,761, also issued to Kuechler, teaches a further variation of a filtering apparatus in which a supply air plenum is provided with perforated balancing plates and deflector plates which perform the functions of modulating an incoming air flow. A filter is arrayed in proximity to an exhaust of the apparatus to facilitate removal of the by-products of appliance.

U.S. Pat. Nos. 4,944,285 and 4,896,657, both issued to Glassman, teach variations of an exhaust hood for a pizza oven which induces exhaust materials into the exhaust stream by creating high velocity flow of outside air into the hood. According to the '285 patent, an intake fan forces outside air into a pair of intake plenums located along opposite sides of the hood, creating two high velocity air streams flowing toward a central exhaust plenum and an exhaust fan drawing air into the exhaust plenum and through inclined grease filters. According to the '657 patent, a central intake fan forces outside air into a central intake plenum and through air deflectors to redirect opposite extending air streams through exhaust plenums on opposite sides of the hood. Exhaust fan draw air into the exhaust plenums and through inclined grease filters.

U.S. Pat. No. 4,655,194, issued to Wooden, teaches a system which includes a hood enclosure having a horizontally arrayed distribution baffle including adjustable diffusion baffle plates. A secondary filter constructed of three or more individual filter layers is mounted to a rearside of the baffle plates and the baffle functions to introduce an intake stream of air in a substantially downwardly extending fashion within and beneath the hood enclosure so as to intermix with rising heat and other undesirable by-products given off by the cooking appliance and prior to additional filtering at the outlet stage and prior to evacuation through an exhaust leading from the hood enclosure.

A shortcoming of the prior art is the inability to create a controlled equilibrium environment within a ventilation hood assembly for facilitating the evacuation of heat, airborne grease, smoke and odors emitted from the cooking appliance while at the same time preventing the loss of quality interior conditioned air through the hood exhaust or the substantial introduction of outside supply air past the hood enclosure and within the room interior. A further shortcoming is the inability to adjust the rate of flow of inlet air into the hood to such a degree of accuracy so as to equal or control the supply flow of air.

SUMMARY OF THE PRESENT INVENTION

The present invention is an overhead ventilation hood for use within a ventilation system for a cooking appliance which provides an improved degree of modification of inlet supply air into the hood to equal or control an exhaust flow of the air and to establish a more equilibrium based internal condition within the hood. The ventilation system includes a first blower mounted in communication with a first length of ductwork extending to the hood and a second blower mounted in communication with a second length of ductwork extending from the hood. The hood includes a housing having a planar shaped base secured at an elevated location above the cooking appliance, the housing having a recessed interior which is arrayed in a downwardly facing manner and which is defined by a first side, a second spaced apart side, a first interconnecting end and a second interconnecting end.

An intake opening is formed through the housing base proximate the first side and is secured to the first length of ductwork for receiving a first stream of pressurized intake air. An exhaust opening is formed through the housing proximate the second side and is secured to the second length of ductwork for exhausting a second stream of pressurized exhaust air.

A supply plenum chamber is established within the recessed interior of the hood enclosure along the first side and is constructed of first and second elongate and planar shaped channeling walls which are interconnected by a planar and elongate diffuser. The diffuser includes a first plurality of fixed grid members which extend substantially the length of the diffuser and a second plurality of forwardly spaced and rotatable blades which are actuable relative to one and between narrowed and widened opening positions so as to regulate a flow of the first stream of pressurized air into the housing.

According to the preferred embodiment, the rotatable blades are sectioned into first, second and third sub-pluralities which are capable of being separately actuated relative to one another. Each of the blades are constructed in a substantially flattened cross sectional shape with pins extending from first and second ends thereof and which engage within apertures formed at opposing locations of a frame for the diffuser and which defines the individual sections. A planar shaped and elongate sliding plate is provided for each sub-section of blades and is located upon a selected side of an end of the frame or of an intermediate cross member providing a boundary for each of the sub-sections. Each of the plates further includes a plurality of substantially "L" shaped channels formed therethrough and in alternating fashion between the first and second ends.

Each of the rotatable blades further includes a third pin of shorter dimension than the second pin and extending in parallel and spaced fashion from the second pin so that the second pin extends through the "L" shaped channels at a first location prior to rotatably mounting to the frame and the third pin extends at a second location to an intermediate point aligning with selected side walls of the "L" shaped channel. First, second and third adjustment members are rotatably mounted to the frame in cooperating fashion with each of the sub-sections of rotatable blades and each further includes a tab member which is seated within a further elongate channel formed within the associated sliding plate so that, upon rotation of said adjustment member by a tool or the like, the associated sliding plate is pivoted in one of two opposite translational directions and thereby causes all the blade members of the selected sub-section plurality to pivot between very specific narrowed and widened opening locations. The construction of the blade diffuser according to the present invention therefore provides an improved and more precise way of "tuning" the air flow into the hood enclosure than is made possible by the prior art assemblies.

An exhaust plenum chamber is established within the recessed interior along the second side and includes an elongate and planar shaped filter which extends between the interconnecting ends and which is mounted by first and second opposed and elongate brackets in an angular orientation relative to the second side. The filter, like the rest of the hood enclosure, is constructed of an aluminized steel or stainless steel material and includes first and second pluralities of individual and parallel extending baffle members which are offset relative to one another and which are secured within a surrounding frame. Each of the baffle members further include in cross section a first leg and a second angularly extending leg and, in operation, the filter effectively removes such contaminants as airborne grease and other objects from the exhausted air stream. The second and lower elongate bracket further includes a trough which collects the grease and other contaminants through apertures in the bottom of the filter which are then emptied into a removable grease tray which is releasably secured to the housing proximate a forward location along the second side.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
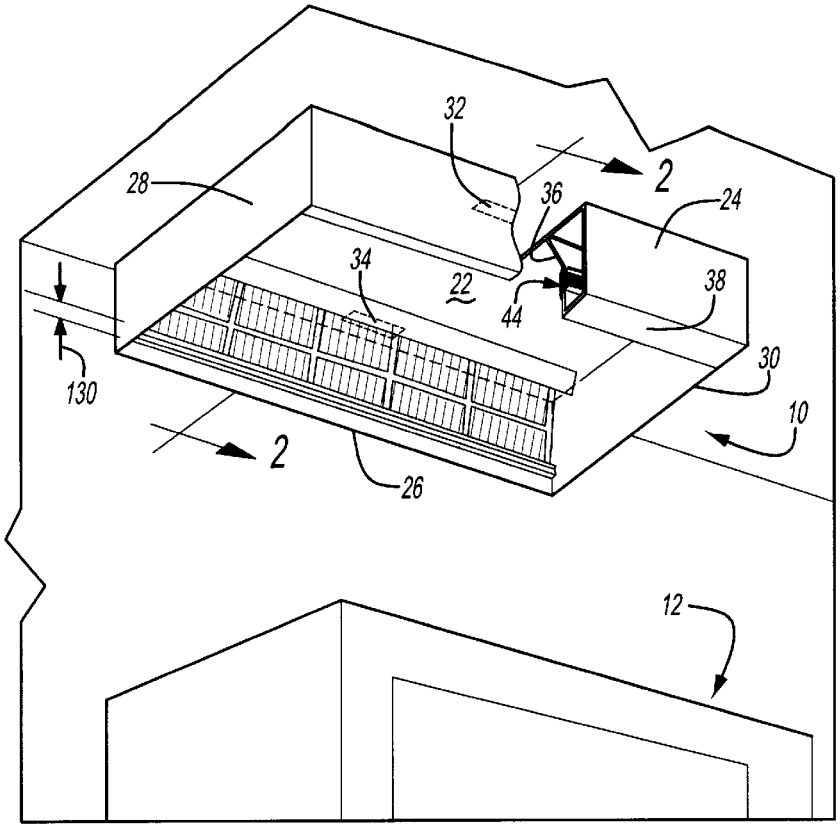
FIG. 1 is an environmental view illustrating the overhead ventilation hood for use within a ventilation system for a conventional cooking appliance according to the present invention.

Referring now to FIG. 1, an overhead ventilation hood is shown at 10 for use within a ventilation system for a conventional cooking appliance 12 according to the present invention. The types of cooking appliances 12 with which the hood 10 may be utilized include pizza ovens, other types of ranges, fryers and just about any other type of commercial appliance which produces a significant level of smoke, heat, airborne grease and odors for which it is desired to evacuate from within an enclosed area.

Figure 2:
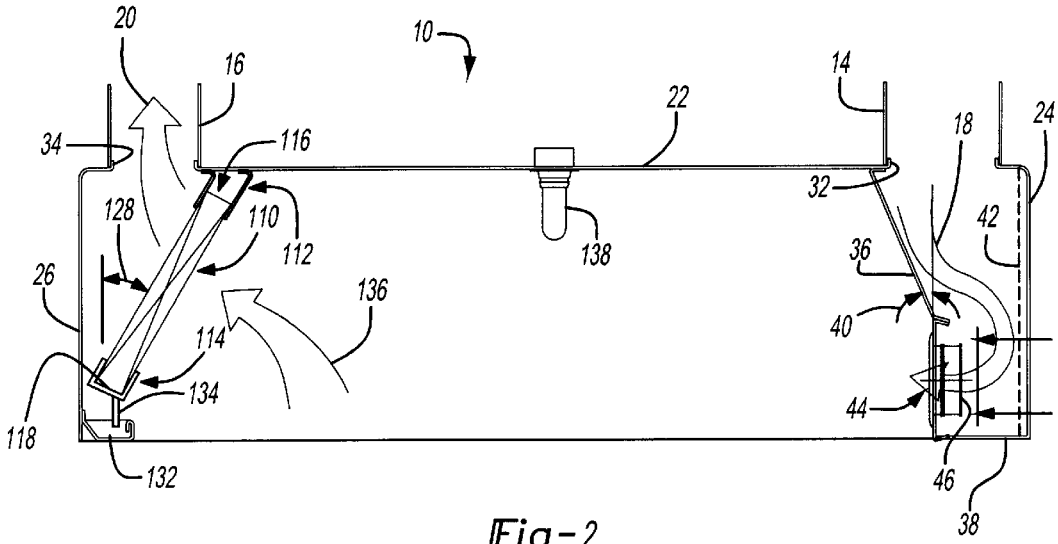
FIG. 2 is a cutaway view taken along line 2—2 of the overhead ventilation hood shown in FIG. 1 and illustrating the supply plenum chamber and the exhaust plenum chamber forming portions of the present invention.

The ventilation hood 10 is incorporated within an overall ventilation system, such system including a first blower (not shown) of conventional construction and mounted in communication with a first length of ductwork 14 (see FIG. 2) extending to the hood 10 at a first location and a second blower (likewise not shown) mounted in communication with a second length of ductwork 16 (again see FIG. 2) extending from the hood at a second location. The ductwork is typically aluminum or other lightweight metal composite suitable for use in the industry. The blowers are typically mounted at a rooftop location above the room enclosure within which the hood 10 is situated and function to introduce a first stream of pressurized intake air 18 through the first length of ductwork 14 and to evacuate a second stream of pressurized exhaust air 20 through the second length of ductwork 20. As will be subsequently described in more detail, the purpose of the intake air 18 is to establish an equilibrium state within the hood enclosure so the quality air within the room enclosure (heated or air conditioned air) is not evacuated with the exhaust air stream 20. The ideal construction of the present invention further prevents the unconditioned or unheated outside supply air from escaping the hood enclosure and intermixing with the quality air within the room.

Referring again to FIG. 1, the hood 10 is constructed of an aluminized steel or stainless steel housing having a planar shaped base 22 which is adapted to be secured at an elevated location above the cooking appliance 12, such as by heavy duty hangers anchored to the ceiling or by other conventional securing means. The housing includes a recessed interior which is arrayed in a downwardly facing manner and forms a substantially rectangular shape which is defined by a first side 24, a second spaced apart side 26, a first interconnecting end 28 and a second interconnecting end 30. An intake opening 32 is formed through the housing base 22 proximate the first side 24 and is secured to the first length of ductwork 14 for receiving the first stream of intake air 18 and a further exhaust opening 34 is formed through the housing base 22 proximate the second side 26 and is secured to the second length of ductwork 16 for receiving the second stream of exhaust air 20.

A supply plenum chamber is established within the recessed interior of the housing an along the first side 24 and includes a first elongate and planar shaped channeling wall 36 extending in an inwardly and downwardly angled direction from the planar shaped base 22 and towards the first side 24 and a second elongate and planar shaped channeling wall 38 extending in a substantially horizontal and inward fashion from a bottom edge of the first side 24. According to the preferred embodiment, the first channeling wall 36 extends at a 30 degree angle relative to a parallel of the first side 24 as is referred to at 40 in FIG. 2. Also included within the supply plenum chamber is a layer of insulation 42 placed over the first extending side 24 to isolate the supply flow air 18 and to act as a barrier prior to it being introduced into the hood enclosure.

Figure 3:
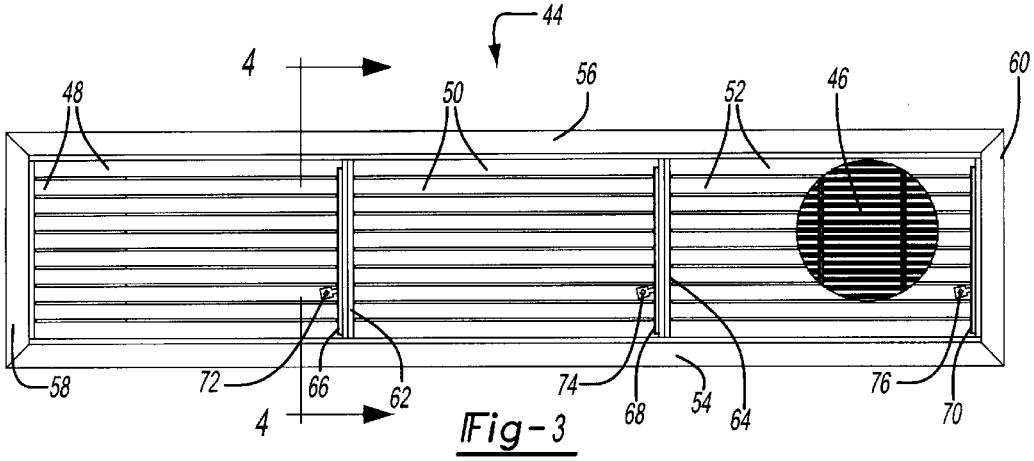
FIG. 3 is a view of the diffuser incorporated into the supply plenum chamber and according to the present invention.

Referring again to FIGS. 1 and 2, and also to FIG. 3, an elongate and planar shaped diffuser 44 is secured at opposite ends thereof to the exposed ends of the first and second planar shaped channeling walls 36 and 38 (such as by welding or the like) and, along with the first and second planar shaped channeling walls, extend the distance between the first and second interconnecting ends 28 and 30 so as to enclose the space defined by the supply plenum chamber. The diffuser 44 is constructed of an aluminized steel or stainless steel material and includes a first plurality of fixed grid members 46 and at least one second plurality of forwardly spaced and rotatable blades. The fixed grid members 46 (as best shown in cross section in FIG. 4) are substantially planar in cross section and extend the length of the diffuser 44.

As best shown in FIG. 3, the rotatable blades are preferably sectioned into first 48, second 50 and third 52 sub-pluralities which are capable of being actuated independently from one another and, along with the first plurality of fixed grid members 46, are mounted within an encircling frame having a first side 54, a second side 56, a first end 58 and a second end 60. A first intermediate cross member 62 and a second intermediate cross member 64 are provided at first and second parallel extending and spaced apart locations along the length of the diffuser 44 and so that the first sub-plurality of blades 48 extend between the first end 58 of the frame and the first intermediate cross member 62, the second sub-plurality of blades 50 extends between the first cross member 62 and the second intermediate cross member 64, and the third sub-plurality of blades 52 extend between the second cross member 64 and the second end 60 of the frame.

Rotatable actuation of each of the sub-pluralities of blades 48, 50 and 52 is provided by first, second and third elongate and planar sliding plates. Specifically, a first sliding plate 66 is located upon a select side of the first intermediate cross member 62 opposing the first end 58, a second sliding plate 68 is located upon a side the second intermediate cross member 64 opposing the first cross member 62 and a third sliding plate 70 is located upon the second end 60 in opposing fashion to the second cross member 64. First, second and third adjustment members 72, 74 and 76 are secured at respective locations to the first and second intermediate cross members 62 and 64 and the second end 60 and are provided for rotatably actuating the first, second and third sub-pluralities of blades 48, 50 and 52 by means of the first, second and third sliding plates 66, 68 and 70, respectively. A more detailed explanation of the manner in which the individual sub-pluralities of blades 48, 50 and 52 are pivoted will now be had with reference to FIGS. 4–8 in succession.

Figure 4:
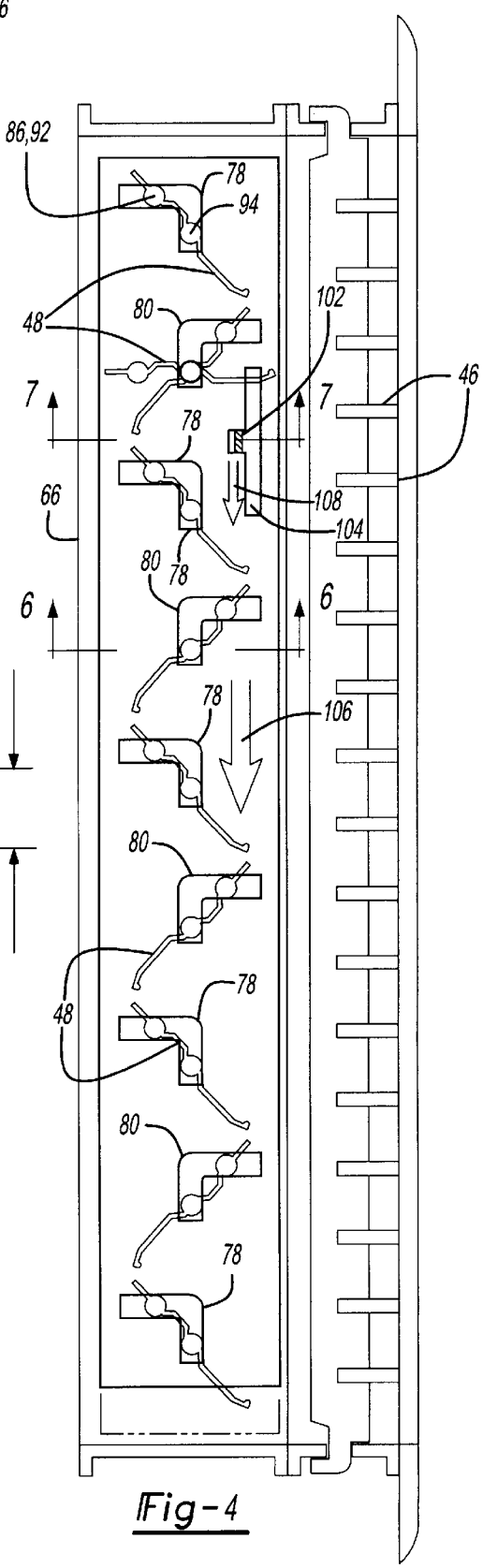
FIG. 4 is a cutaway view taken along line 4—4 of FIG. 3 and illustrating a cross section of the rotatable blades according to a selected sub-plurality and the sliding plate with "L" shaped channels for accomplishing the pivotal range of motion of the blades according to the present invention.

Referring first to the cutaway of FIG. 4, the first sliding plate 66 is illustrated in cooperation with the first sub-plurality 48 of blades shown in cross section and rotatable between substantially narrowed and widened opening positions. Each of the sliding plates, and as is best illustrated by sliding plate 66, includes a plurality of substantially "L" shaped channels which are formed therethrough and in alternating fashion between the first and second ends of the sliding plate 66. Specifically, the alternating arrangement of the plurality of "L" shaped channels is best illustrated by the first pattern 78 which alternates with a second pattern 80 in both an offset and opposite facing manner the purpose for which, as will now be described, is to enable the selected sub-plurality of blades 48 to pivotally actuate.

Figure 6:
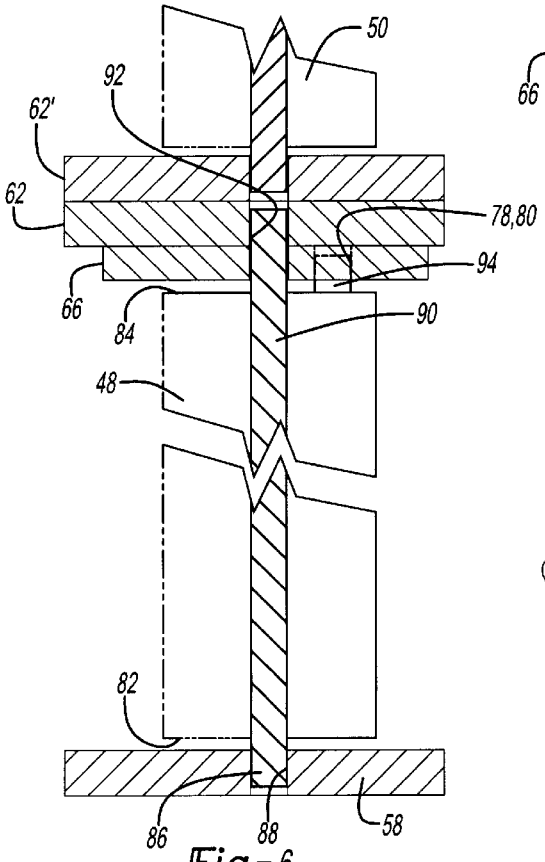
FIG. 6 is a cutaway view taken along line 6—6 of FIG. 4 and showing in longitudinally extending fashion a selected blade member its manner of being actuated to pivot within the frame and by the sliding plate according to the present invention.

Each of the blades 48, as shown in cross section in FIG. 4 includes a substantially flattened cross sectional shape and, as further illustrated in FIG. 6, includes a first end 82 and a second end 84. A first pin 86 extends longitudinally from the first end 82 of the selected blade 48 and rotatably seats within an aperture 88 formed in the first end 58 of the frame. A second pin 90 extends longitudinally from the second end 84 of the blade 48, through a selected channel 78 or 80 at a first location, and likewise rotatably seats within an aperture 92 formed in the first intermediate cross member 62. A third pin 94 of shorter dimension than the second pin 90 extends in parallel and spaced fashion from the second pin 90 and so as only to extend a partial distance (or intermediate point) through a same selected channel 78 or 80 at a second location and aligning with selected side walls of the "L" shaped channel. As is also best shown in FIG. 6, a blade 50 from the second sub-plurality extends in aligning fashion from a reverse face 62' of the first intermediate cross member in identical fashion to the blade 48 of the first sub-plurality so as to be capable of being independently adjustable along with other identical blades of the second sub-plurality.

Figure 5:
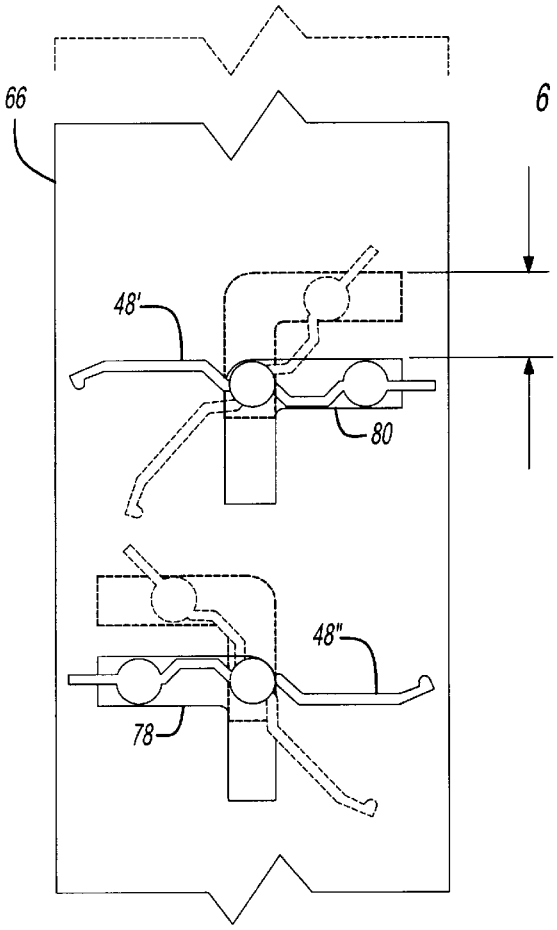
FIG. 5 is an enlarged view similar to FIG. 4 and further illustrating the range of pivotal motion of first and second blades between narrowed and widened opening positions according to the present invention.

Referring again to the cross sectional view of FIG. 4, the uppermost located blade 48 illustrates the first and second pivot pins 86 and 92 along a common axis and the third pin 94 along the spaced apart axis. Each of the blades 48, 50 and 52 pivot along the directions of the third pins within their associated channels or tracks 78 and 80 and the arrangement of the channels in alternating and offsetting fashion is what facilitates the blades moving between narrowed and widened and widening opening positions. Referring further to FIG. 5, an enlarged view is shown of a first selected blade 48' and a second selected blade 48" arranged within selected "L" shaped channels 78 and 80. The blades 48' and 48" are first shown in solid to illustrate a substantially parallel extending and widened opening position. The blades 48' and 48" are also illustrated in phantom to show a substantially narrowed position. The range between the most widened and most closed positions determines the degree of air flow through the diffuser 44 and is adjustable so as to "tune" the airflow so that it substantially equals the degree of flow being exhausted through the second opening 34.

Figure 7:
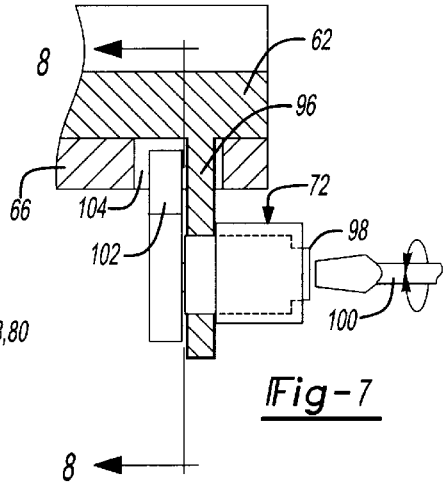
FIG. 7 is a cutaway view taken along line 7—7 of FIG. 4 and showing a first view of a selected adjustment member rotatably secured to the frame and operable to pivotally actuate a selected sub-plurality of blade members.
Figure 8:
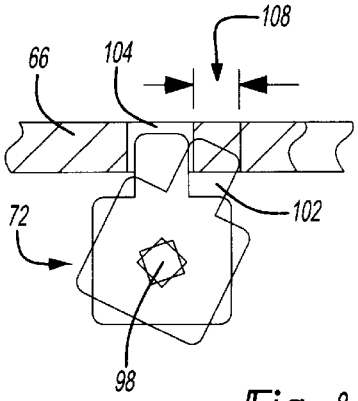
FIG. 8 is a cutaway view taken along line 8—8 of FIG. 7 and showing the extending tab member of the selected adjustment member seated within the associated elongate channel in the sliding plate and actuable to translate the plate in one of two opposite directions.

Referring to FIG. 7, the first adjustment member 72 is shown in side profile and secured in extending fashion from the first cross member 62 by means of a connecting portion 96. As is also shown in the enlarged view of FIG. 8, the first adjustment member 72 is rotatably mounted within the connecting portion 96 and includes an aperture 98 which is suitable for receiving in inserting fashion a screw driver head or like tool surface 100. Extending from adjustable member 72 is a tab portion 102 which in turn seats within a further elongate channel 104 formed within the sliding plate 66 (see at 104 for sliding plate 66 also in FIG. 4). Rotatable motion imparted to the adjustment member 72 causes the tab portion 102 to translate the sliding plate 66 in one of two opposite translational directions, such as at 106 in FIG. 4, and equivalent to the distance 108 also identified in FIG. 8 so that the selected sub-pluralities of blades are moved between their narrowed and widened opening positions so as to tune the incoming airflow.

Referring again to FIG. 2, an exhaust plenum chamber is established within the interior of the hood enclosure and along the second extending side 26. The exhaust chamber is defined in large part by an elongate and planar shaped filter 110 which extends between the first and second interconnecting sides 28 and 30 and which is secured to the housing interior by a first upper and elongate bracket 112 and a second lower, spaced apart and opposingly facing, bracket 114. The first bracket 112 defines a first inwardly facing channel 116 and the second bracket 114 substantially defines a second inwardly facing channel 118 for receiving opposite engaging ends of the filter 110.

Figure 9:
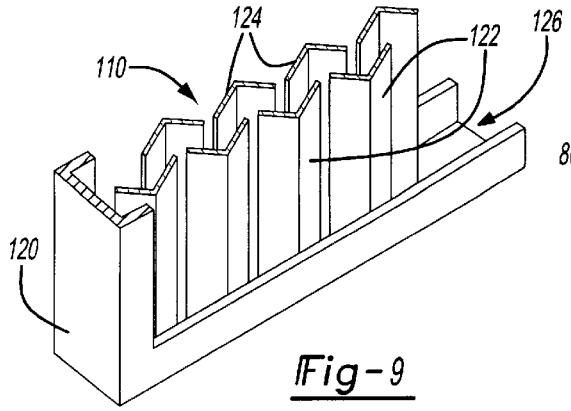
FIG. 9 is a cutaway view of the filter forming a portion of the exhaust plenum chamber and further illustrating the pluralities of spaced apart baffle members for filtering impurities from the exhausted air flow.

As is further best illustrated in the sectioned view of FIG. 9, the filter 110 is constructed of an aluminum or stainless steel material and particularly includes an encircling frame 120 which secures and supports a first plurality of individual and parallel extending baffle members 122 and a second spaced apart plurality of individual and parallel extending baffle members 124. The pluralities of baffle members 122 and 124 may be secured to the frame 120 by welding or other conventional attachment means as are known in the art and each individual baffle member 122 and 124 includes in cross section a first leg and a second angularly extending leg as is clearly illustrated. The purpose of the baffle members is to provide a circuitous path for the exhaust stream 20 as it passes through to the exhaust plenum chamber and out through the second length of ductwork 16 to facilitate the collection of airborne particles from the exhaust stream, such typically including airborne grease and other contaminants. For this purpose, the bottom of the frame 120 may be open in whole or in part (see at 126) to facilitate the pass through of the grease through the bottom of the filter 56 and an explanation of the ability to collect and reposit the airborne contaminants will be described below.

Referring again to FIG. 2, the filter 110 is illustrated in a releasably mounted fashion within the hood enclosure interior in an upwardly and outwardly extending and specified angular orientation relative to a vertical axis extending through the second side 26. Preferably the filter 110 extends at a thirty degree angular orientation 128 relative to the vertical and encloses a substantially triangular shaped area which defines the exhaust plenum chamber. The inwardly facing channel 118 of the second and lower extending bracket 114 further defines a collection trough which is capable of collecting the airborne grease and other contaminates from the stream of exhaust air (via the filter 110). As is illustrated in FIG. 1, the lower bracket 114 with collection trough preferably is angled to a minor degree off the horizontal axis, as shown at 130, towards a forward end of the second side 26 and in proximity to the first interconnecting end 28. Referring back to FIG. 2, a grease collection tray 132 is releasably secured to the housing proximate the forward and interconnecting location of the second side 26 with the first interconnecting end 28 and beneath a communicating opening 134 in the trough (and which represents the lower-most position of the trough) for collecting the grease captured by the filter 110. The filter 110 operates in cooperation with the inlet air supply to effect more complete exhausting of the heat, smoke, airborne grease, odors and other undesirable by-products of the cooking device (as illustrated by the directional arrows 136 in FIG. 1) and for which it is desirable to evacuate from the room enclosure. A light fixture 138 may also be secured at a generally centralized location to the base surface 22 of the hood enclosure to provide a desired degree of illumination within the enclosure interior.

In specific preferred embodiments, the overall dimensions of the rectangular hood enclosure include the first and second sides, the diffuser and channeling walls, the filter element, and the deflector (which form portions of the supply plenum and exhaust plenum chambers), and the interconnecting ends being established at such lengths as 7'6", 9'0" and 10'0" to accommodate cooking devices, and particularly pizza ovens, of differing dimensions. However, the range of dimension of such hood enclosures may extend between 4'0" up to 16'0" according to the desired application. The overall depth of the sides and interconnecting ends may also vary, but a standard 2.0 feet has been found to be sufficient for accomplishing the necessary air mixing, filtration and removal according to the objectives of the present invention for evacuating the by-products of the cooking process with minimal disturbance to the internal equality condition of the air in the room enclosure.

Having described our invention, it will become apparent that it discloses a novel and improved hood for use within a ventilation system which is an improvement over the prior art devices. Additional embodiments will become apparent to those skilled in the art to which it pertains without deviating from the scope of the appended claims. Specifically, the rotatable sub-pluralities of blades can be mounted within the frame so as to extend in a perpendicular (or vertical) fashion with respect to the fixed grid members in addition to the horizontal and parallel extending fashion disclosed and by utilizing the pin mountings and sliding plates disclosed in the preferred embodiments.

We claim:

1. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including at least one elongate and planar shaped channeling wall and an interconnecting elongate and planar shaped diffuser extending between said first and second interconnecting ends and proximate an open bottom of said recessed interior, said diffuser including a first plurality of fixed grid members and a second plurality of rearwardly spaced and rotatable blades, said blades being actuable relative to one another along a limited range of rotational motion so that said diffuser regulates a flow of said first stream of pressurized air into a central open interior of said housing; and an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing.

2. The overhead ventilation hood according to claim 1, said elongate and planar shaped filter further comprising a first plurality of individual and parallel extending baffle members and a second spaced apart plurality of individual and parallel extending baffle members which are offset relative to said first plurality of baffle members, said first and second pluralities of baffle members being secured within a surrounding frame.

3. The overhead ventilation hood according to claim 2, said first and second pluralities of baffle members each further comprising in cross section a first leg and a second angularly extending leg.

4. The overhead ventilation hood according to claim 1, further comprising a light fixture mounted to said base surface and extending within a central location of said housing.

5. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including a first elongate and planar shaped channeling wall extending from said base surface in an angular direction towards said first side, a second elongate and planar shaped channeling wall extending in a substantially horizontal and inward fashion from a bottom edge of said first side, an elongate and planar shaped diffuser extending between first and second exposed ends of said first and second channeling walls, said diffuser being arranged in a substantially vertical extending and parallel spaced apart manner with respect to said first side and including a plurality of spaced apart and rotatable blades, said blades being actuable relative to one another along a limited range of rotation motion so that said diffuser regulates a flow of said first stream of pressurized air into a central open interior of said housing; and an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing.

6. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including a first elongate and planar shaped channeling wall extending from said base surface and in an inwardly and downwardly angled direction towards said first side, a second elongate and planar shaped channeling wall extending from along a bottom edge of said first side in a substantially horizontal and inward fashion, an interconnecting elongate and planar shaped diffuser extending between said first and second interconnecting ends of said housing and interconnecting at opposite sides to remote extending edges of said first and second channeling walls, said diffuser including a first plurality of fixed grid members and a second plurality of rearwardly spaced and rotatable blades, said blades being actuable relative to one another along a limited range of rotational motion so that said diffuser regulates a flow of said first stream of pressurized air into a central open interior of said housing; and an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing.

7. The overhead ventilation hood according to claim 6, said first elongate and planar shaped channeling wall extending at a 30 degree angle relative to a said first side.

8. The overhead ventilation hood according to claim 6, said supply plenum chamber further comprising a layer of insulation secured to an interiorly facing surfaces of said first side.

9. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including at least one elongate and planar shaped channeling wall and an interconnecting elongate and planar shaped diffuser extending between said first and second interconnecting ends, said diffuser including a first plurality of fixed grid members and a second plurality of rearwardly spaced and rotatable blades, said plurality of rotatable blades further comprising first, second and third individual sub-pluralities of rotatable blades capable of being separately actuated relative to one another between substantially narrowed and widened opening positions, said blades being actuable relative to one another along a limited range of rotational motion so that said diffuser regulates a flow of said first stream of pressurized air into a central open interior of said housing;

a frame surrounding said first plurality of fixed grid members and said second plurality of rotatable blades of said diffuser, said frame including a first side, a second side, a first end and a second end; and an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing.

10. The overhead ventilation hood according to claim 9, further comprising said first sub-plurality of rotatable blades extending between said first end of said frame and a first intermediate cross member, said second sub-plurality of said rotatable blades extending between said first intermediate cross member and a second intermediate cross member, said third sub-plurality of said rotatable blades extending between said second intermediate cross member and said second end of said frame.

11. The overhead ventilation hood according to claim 10, each blade of said first, second and third sub-pluralities of blades further comprising a substantially flattened cross sectional shape with a first end and a second end, a first pin extending longitudinally from said first end and rotatably seating within an aperture formed in a selected and sub-sectioned end of said frame, a second pin extending longitudinally from said second end and likewise rotatably seating within an aperture formed in a further selected and sub-sectioned end of said frame and which is in opposing arrangement to said first pin.

12. The overhead ventilation hood according to claim 11, said actuation of said sub-pluralities of blades in separate fashion further comprising a first elongate and planar sliding plate located upon a side of said first intermediate cross member opposing said first end, a second elongate and planar sliding plate located upon a side of said second intermediate cross member opposing said first cross member, and a third elongate and planar sliding plate located upon said second end opposing said second cross member.

13. The overhead ventilation hood according to claim 12, each of said elongate and planar sliding plates further comprising a plurality of substantially "L" shaped channels formed therethrough and in alternating fashion from said first end to said second end, each blade of said sub-pluralities of blades further comprising a third pin of shorter dimension than said second pin and extending in parallel and spaced fashion from said second pin, said second pin extending through each of said channels at a first location and rotatably mounting within said associated aperture, said third pin extending at a second location to an intermediate point aligning with selected side walls of said "L" shaped channel.

14. The overhead ventilation hood according to claim 13, each of said first, second and third sub-sectioned pluralities of blades further comprising an adjustment member rotatably secured to said frame and capable of actuating said blades between opposing narrowed and widened opening positions.

15. The overhead ventilation hood according to claim 14, each of said elongate and planar sliding plates further comprising a further elongate channel within which is seated a tab portion extending from said associated adjustment member and, whereupon rotation of said adjustment member, said associated sub-plurality of blades being caused to pivot between said narrowed and widened opening positions.

16. An overhead ventilation hood for use within a ventilation system for a cooking appliance, the ventilation system including a first blower mounted in communication with a first length of ductwork extending to the hood and a second blower mounted in communication with a second length of ductwork extending from the hood, said ventilation hood comprising:

a housing having a planar base surface adapted to be secured at an elevated location above the cooking appliance, said housing including a recessed interior which is arrayed in a downwardly facing manner and which is defined by a first side, a second spaced apart side, a first interconnecting end and a second interconnecting end;

an intake opening formed through said housing base proximate said first side and adapted to be secured to the first length of ductwork for receiving a first stream of pressurized intake air, an exhaust opening formed through said housing base proximate said second side and adapted to be secured to the second length of ductwork for issuing a second stream of pressurized exhaust air;

a supply plenum chamber established within said recessed interior and along said first side, said supply plenum chamber including at least one elongate and planar shaped channeling wall and an interconnecting elongate and planar shaped diffuser extending between said first and second interconnecting ends, said diffuser including a first plurality of fixed grid members and a second plurality of rearwardly spaced and rotatable blades, said blades being actuable relative to one another along a limited range of rotational motion so that said diffuser regulates a flow of said first stream of pressurized air into a central open interior of said housing;

an exhaust plenum chamber being established within said recessed interior and along said second side, said exhaust plenum chamber including an elongate and planar shaped filter extending between said first and second interconnecting ends and capable of being releasably secured to said housing at a specified angular orientation relative to said second side; and a first elongate bracket secured to said base surface and extending between said first and second interconnecting ends, said first bracket defining a first inwardly facing channel for receiving an upper edge of said filter, a second elongate bracket secured to said second side proximate a bottom edge and likewise extending between said first and second interconnecting ends, said second bracket defining a second inwardly facing channel for receiving a corresponding lower edge of said filter, said second bracket further including a collection trough in communication with said second inwardly facing channel, said trough capable of collecting airborne grease filtered from said stream of exhaust air;

the cooking appliance issuing combinations of heat, airborne grease and smoke in an upward direction into said open interior of said housing which are discharged within said second stream of exhaust air concurrent with intermixing with said regulated flow of said first stream of intake air and so as to achieve an air equilibrium condition within said housing.

17. The overhead ventilation hood according to claim 16, further comprising a grease collection tray releasably secured to said housing proximate a forward located interconnecting end and beneath a opening in said trough, a longitudinal axis extending through said trough descending a selected and minimal height relative to a horizontal axis and in a direction towards said forward location to facilitate said collection of filtered grease.

18. The overhead ventilation hood according to claim 16, said filter extending at a thirty degree angle relative to said second side of said housing.

* * * * *